United States Patent [19]

Michal et al.

[11] Patent Number: 5,062,331

[45] Date of Patent: Nov. 5, 1991

[54] APPARATUS AND METHOD FOR EDGE NOTCHING A CONTINUOUSLY MOVING WEB

[75] Inventors: Vratislav M. Michal; Ralph S. Barbaro, both of Rochester, N.Y.

[73] Assignee: Eastman Kodak Company, Rochester, N.Y.

[21] Appl. No.: 390,129

[22] Filed: Aug. 7, 1989

[51] Int. Cl.[5] ..... B26D 1/56

[52] U.S. Cl. ..... 83/37; 83/337; 83/692; 83/916; 83/917

[58] Field of Search ..... 83/37, 38, 284, 285, 83/321, 406, 437, 436, 559, 615, 627, 628, 671, 693, 692, 916, 917; 408/55; 409/244, 257, 262, 270, 271

[56] References Cited

U.S. PATENT DOCUMENTS

| | | | |
|---|---|---|---|
| 3,242,785 | 3/1966 | Schieven et al. | 83/917 X |
| 3,411,390 | 11/1968 | Maynard et al. | 83/917 X |
| 3,465,633 | 9/1969 | Reynolds et al. | 83/693 |
| 3,782,233 | 1/1974 | Helm | 83/917 X |
| 4,072,076 | 2/1978 | Miles | 83/917 X |
| 4,115,000 | 9/1978 | Mischo et al. | 83/917 X |
| 4,532,845 | 8/1985 | Jinnouchi | 83/559 X |
| 4,696,211 | 9/1987 | Bitzel | 83/916 X |
| 4,903,559 | 2/1990 | Landeck | 83/917 X |
| 4,936,178 | 6/1990 | Ebmeyer et al. | 83/628 |

*Primary Examiner*—Frank T. Yost
*Assistant Examiner*—Rinaldi Rada
*Attorney, Agent, or Firm*—Charles E. Snee

[57] ABSTRACT

An apparatus for edge notching moving webs (10) comprises a reciprocating punch (82) and die (64) which are rotated on a turntable (56) at a tangential speed matching the web speed and are actuated by a fixed cam (100) and a moving follower (94,96) connected to the punch. A related method is disclosed.

8 Claims, 2 Drawing Sheets

APPARATUS AND METHOD FOR EDGE NOTCHING A CONTINUOUSLY MOVING WEB

TECHNICAL FIELD

The present invention concerns an apparatus and method for precisely edge notching a moving web. The invention is particularly adapted for providing reference notches in the edges of a moving web which are detected during subsequent handling of the web to initiate desired operations.

BACKGROUND ART

A variety of devices have been proposed for providing such edge notches; however, they have tended to be rather complex due to the need to precisely synchronize punch and die elements moving on separately moving or rotating linkages or elements. For example, U.S. Pat. No. 3,242,785 granted to Schieven discloses a web notcher in which a die is rotated so that the die part and its ends move on circular paths in a plane perpendicular to the plane of movement of the web. A punch included in the same linkage engages the web and the die to form the desired notch. U.S. Pat. No. 3,411,390 granted to Maynard discloses a web notching device in which the web moves between rollers to be notched. As one of these rollers turns, cutter wheels mounted on its end surfaces are rotated by a pair of adjacent stationary ring cams; so that, the cutters pass through the web and die to form the desire notches. U.S. Pat. No. 4,072,076 granted to Miles discloses a punching apparatus in which punches on the periphery of a wheel engage spaced cutting dies on the periphery of an adjacent wheel to form notches in the moving web. The plane of rotation of the dies and punches is perpendicular to that of the web. U.S. Pat. Nos. 4,115,000 and 4,115,001 granted to Mischo disclose a web marking or punching apparatus in which punches are mounted on a disk which rotates in a plane perpendicular to the web; so that, the punches engage the web and a stationary die at the desired locations.

While these types of prior art edge notching apparatus have achieved a certain measure of success, a need has continued to exist for a simpler edge notching apparatus not requiring the use of relatively rotating punch and die elements.

SUMMARY OF THE INVENTION

An object of the invention is to provide an edge notching apparatus and method for moving webs which will not interfere with movement of the web as the notches are formed.

A further object of the invention is to provide such an apparatus and method in which the pitch or distance between notches will remain fixed regardless of the speed at which the web is moving.

These objects of the invention are given only by way of illustrative examples; thus, other desirable objectives and advantages inherently achieved by the disclosed invention may occur or become apparent to those skilled in the art. Nonetheless, the scope of the invention is to be limited only by the appended claims.

In an apparatus according to the invention for edge notching a moving web, means are provided for supporting such a web as it moves under slight tension, to establish a substantially straight run of moving web. At least one die is provided which has an opening for at least partially defining the geometry of a notch to be made in the web. Similarly, at least one reciprocating punch is provided which has a shape for cooperating with the opening in the die to form the desired notch. The die and the punch are positioned on opposite sides of the moving web and are mounted on a platform which rotates about an axis substantially perpendicular to the plane of the straight run of web. As a result, the punch and die move in concentric circular paths in substantially parallel planes on opposite sides of the web. Means are provided for driving the punch through the die at least once during each revolution when the punch and die are positioned properly with respect to the edge of the web, to form the desired notches.

So that the reciprocating punch will not interfere with movement of the web following formation of a notch, the punch is essentially cylindrical and comprises a first radially extending slot through which the edge portion of the moving passes just prior to actuation of the punch. Just above the first slot is located a second radially extending slot through which the edge portion of the moving web passes after actuation of the punch until the punch and die pair has been rotated away from engagement with the moving web. The apparatus is actuated by means of a cam follower operatively connected to the punch and a cam fixedly mounted adjacent to the follower and provided with a cam surface over which the follower moves to extend and retract the punch. To facilitate adjusting the transverse depth of the notch in the moving web, the entire structure for supporting the rotating punch and die is adapted for movement transversely relative to the web. As a result, the transverse location of the notch may be adjusted for a particular web or for webs having different widths.

In the method according to the invention, the moving web is supported under slight tension to provide a substantially straight run. At least one die is provided having an opening for at least partially defining the geometry of an edge notch. At least one punch is provided having a shape for cooperating with the opening to form the notch. The die and punch are supported and rotated for respective movement in concentric circular paths in substantially parallel planes on opposite sides of the moving web, with the tangential velocity of the die and the punch substantially equal to the linear velocity of the moving web. When the punch and die are properly positioned relative to the edge of the moving web, the punch is driven through the die to form the notch.

BRIEF DESCRIPTION OF THE DRAWINGS

The foregoing and other objects, features and advantages of the invention will be apparent from the following more particular description of the preferred embodiments of the invention, as illustrated in the accompanying drawings.

DETAILED DESCRIPTION OF THE PREFERRED EMBODIMENTS

Figure 1:
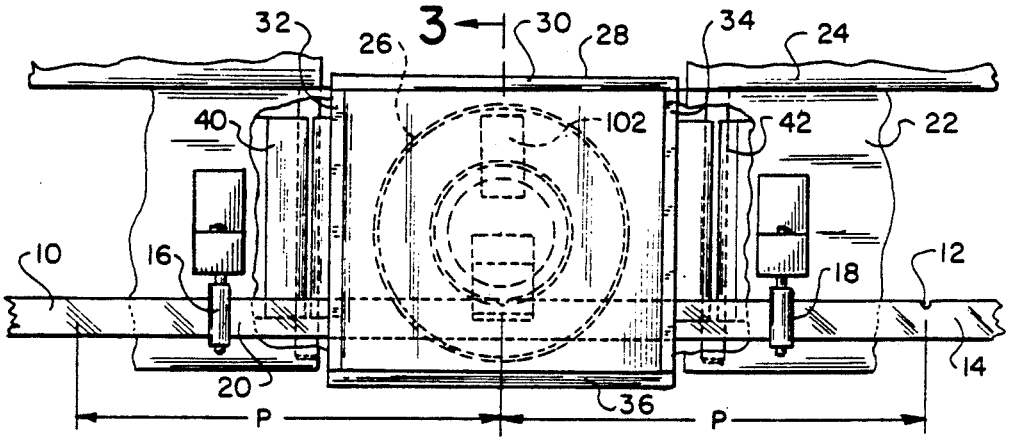
FIG. 1 shows a plan view, partially broken away, of an apparatus according to the invention.

The following is a detailed description of the preferred embodiments of the invention, reference being made to the drawings in which the same reference numerals identify the same elements of structure in each of the several Figures.

Figure 2:
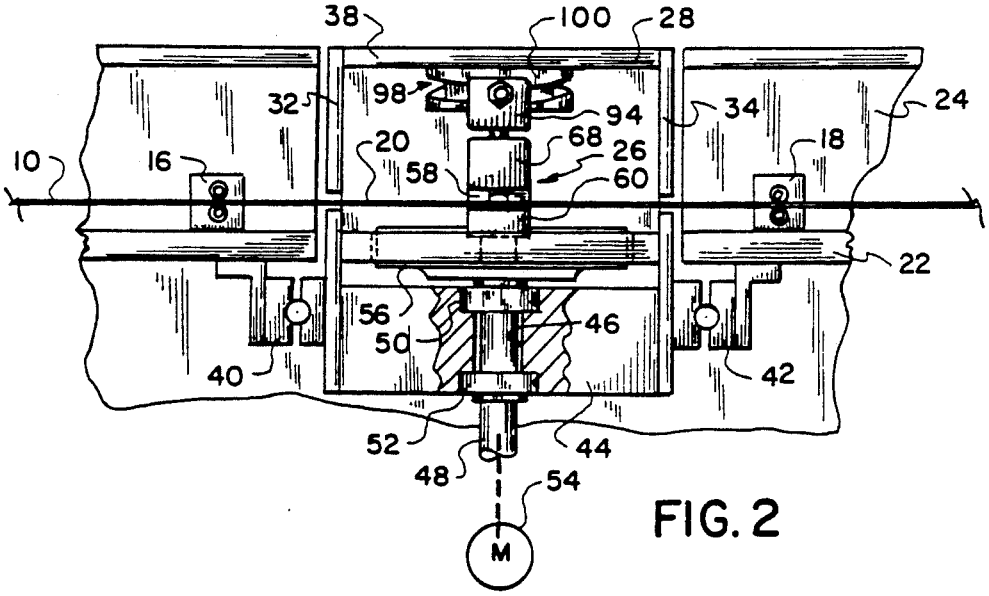
FIG. 2 shows a front elevation view of an apparatus according to the invention taken along line 2—2 of FIG. 1.

Referring to FIGS. 1 and 2, a moving web 10 is illustrated which is to be provided with edge notches 12 spaced at a pitch P along one edge 14. By means of a suitable servo-motor driven pacer roller, not illustrated, web 10 is moved under slight tension between pairs of spaced, idler rollers 16,18; so that, a substantially straight run 20 is provided in web 10.

In the region of straight run 20, a frame is provided which comprises a bed plate 22 on which roller pairs 16,18 are mounted for supporting web 10.

Preferably, rollers 16,18 include small end flanges to laterally guide web 10. The frame also includes a back plate 24. The apparatus for edge notching according to the present invention is mounted within a housing 28 having a back wall 30, side walls 32,34, front wall 36, top wall 38 and a bottom wall, not illustrated. Attached to side walls 32,34 are conventional guide rails for slides 40,42 which support housing 28 from the underside of bed plate 22 to allow apparatus 26 to be moved transversely relative to moving web 10 to account for webs of different widths and to permit adjustment of the depth of notch 12. Conventional means such as lead screws, not illustrated, may be used to move housing 28.

Within housing 28, a shaft support block 44 is rigidly mounted. A central bore 46 in block 44 receives a shaft 48 supported by axially spaced bearings 50,52 and driven by a motor 54, shown schematically. At the upper end shaft 48 is attached a turntable 56 made from a suitable material such as stainless steel.

Mounted for rotation with turntable 56 is a die and punch assembly 58 according to the invention. Assembly 58 comprises a base and die holder 60 rigidly attached to turntable 56 and including a stepped through bore 62 in which a ring die 64 is mounted. Die 64 preferably is made from a material such as tool steel and is provided with a downwardly flared central bore 66. Rigidly mounted on the upper surface of holder 60 is a punch guide block 68. Block 68 may be made from a suitable material such as stainless steel and is provided with a radially inner guide dowel bore 70 and a radially outer punch bore 72. Within bore 70 is mounted a guide dowel bearing or bushing made from a suitable material such as bronze. Similarly, within punch bore 72 are mounted a pair of axially spaced punch bearing or bushings 76,78 of the same material. To permit edge 14 of web 10 to be easily positioned above bore 66, a relief notch 80 is provided at the radially outermost end of guide block 68. A punch 82 is slideably mounted in bearings 76,78. Preferably, punch 82 is made from a material such as tool steel and is provided with a cutting end 84 as shown in FIGS. 4–6 and a head end 86.

Figure 3:
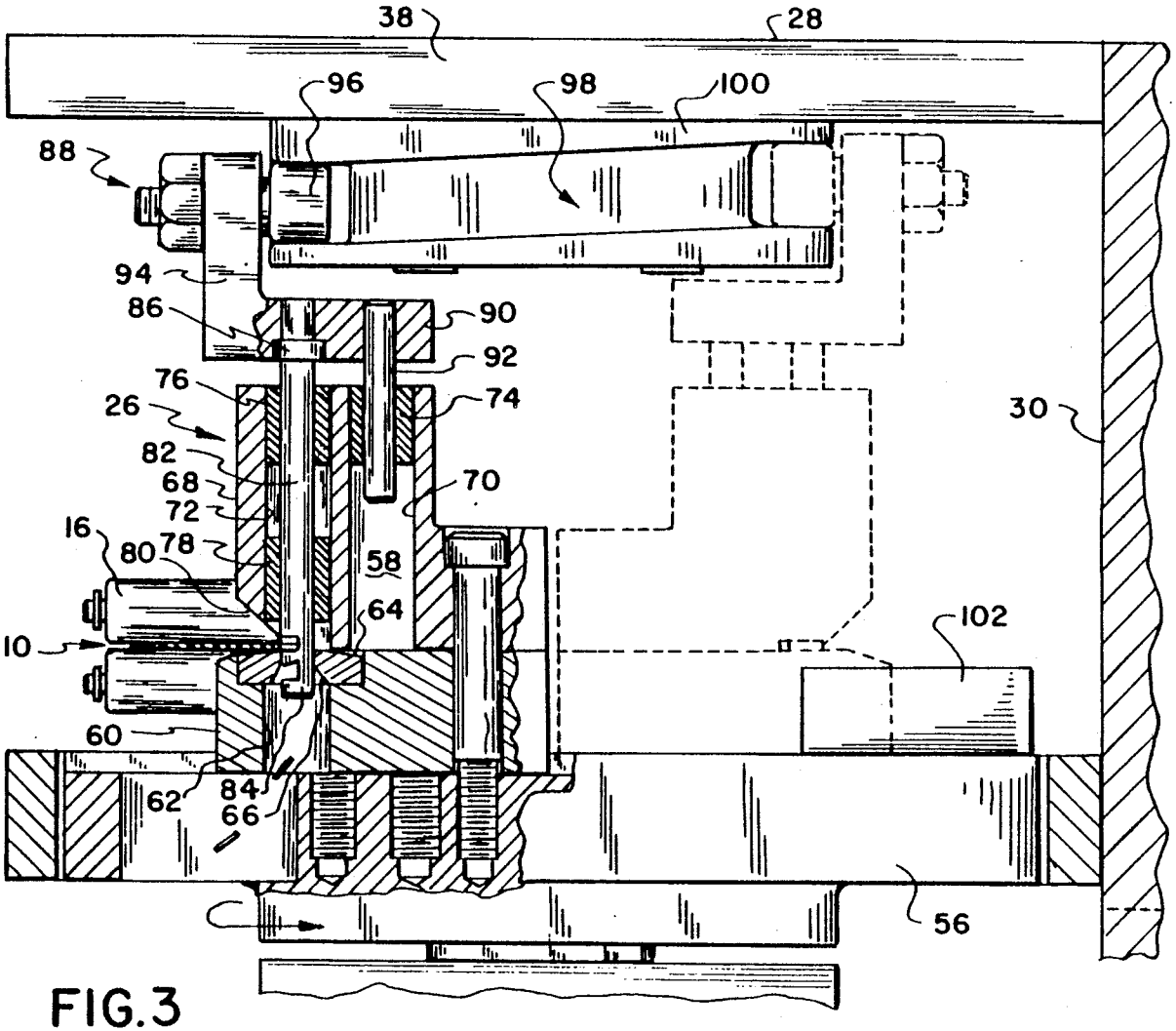
FIG. 3 shows a side elevation view of an apparatus according to the invention just after a notch has been cut, taken along line 3—3 of FIG. 1.

To drive punch 82 during operation, head end 86 is captured in a cam follower 88 having a radially inwardly projecting arm 90 which supports a guide dowel 92 of a material such as tool steel, guide dowel 92 being slideably mounted in bearing 74. Cam follower 88 also comprises an axially extending arm 94 which supports a radially inwardly projecting cam roller 96 which rides in a circumferentially extending cam slot 98 formed in a cylindrical cam 100 attached rigidly to top wall 38 of housing 28. Cam slot 98 is shaped as necessary to force punch 82 downward to notch the edge of web 10 at the position shown in FIG. 3. Also, cam slot 98 is shaped as necessary to raise punch 82 upward, after approximately 180° of rotation of turntable 56, to the position shown in phantom in FIG. 3. To ensure that notches 12 are formed at pitch P, motor 54 is rotated at a speed chosen to ensure that the tangential speed of die and punch assembly 58 at about the center of punch 82, is essentially equal to the linear speed of web 10. Those skilled in the art will appreciate that this may be accomplished with conventional gear trains or control systems, not illustrated, to control the speeds of motor 54 and the servo-motor driving web 10.

To balance the inertial effect of punch and die assembly 58, a counterweight 102 preferably is provided on turntable 56 at a location approximately 180° away from assembly 58. Although the illustrated embodiment of the invention has only one pair of assembly 58 and counterweight 102, those skilled in the art will appreciate that the counterweight could be replaced by a second assembly 58 positioned directly opposite the first, in which case notches would be formed at one-half pitch P, assuming there is no change in the speed of web 10 and turntable 56. Of course, additional equally spaced assemblies 58 may be added to reduce the length of pitch P; or the radial position of assembly 58 may be changed to change its tangential speed.

Figure 5A:
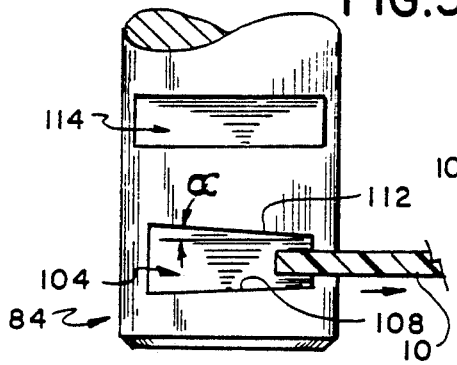
FIGS. 5A and 5B show front and side elevation views of the cutting end of the punch according to the invention.
Figure 5B:
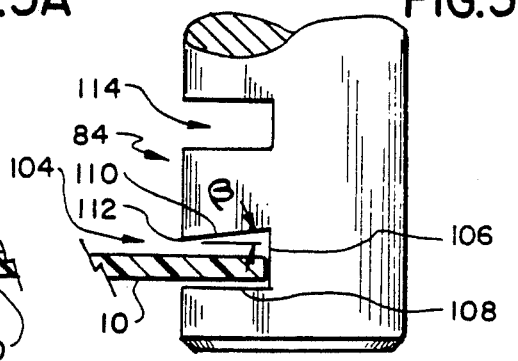
Figure 4:
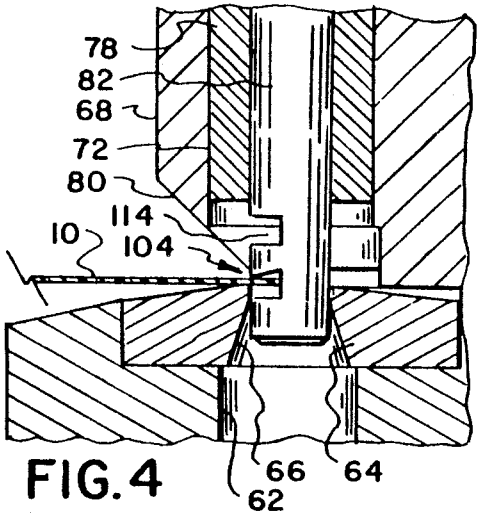
FIG. 4 shows an enlarged view of the punch and die structure according to the invention just as the punch engages the moving web to begin forming a notch.
Figure 6:
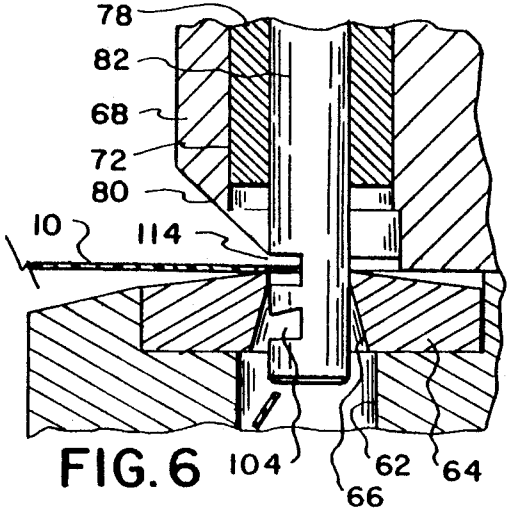
FIG. 6 shows an enlarged view of the punch and die structure according to the invention just after a notch has been cut.

FIGS. 4–6 show the details of cutting end 84 of punch 82 and also illustrate how the punch cooperates with die 64 to produce clean, repeatable notches. Just before assembly 58 has been rotated into the position illustrated in FIG. 3, a radially extending slot 104 in cutting end 84 receives the edge 14 of web 10. Slot 104 comprises a rear wall 106 which extends axially essentially parallel to the direction of movement of punch 82, and transversely essentially parallel to the direction of movement of web 10 at the time of formation of a notch. Slot 104 also includes a bottom wall 108 essentially perpendicular to rear wall 106 and a top wall 110. To provide a proper cutting edge for formation of notch 12, the leading or shearing edge 112 of top wall 110 is tapered circumferentially upwardly and oppositely to the direction of rotation at an angle alpha of 2°–3° as seen most clearly in FIG. 5A. Also, top wall 110 tapers radially inwardly and axially upwardly at an angle beta of about 2° shown in FIG. 5B.

As punch 82 is driven downwardly due to movement of roller 96 through slot 98, notch 12 is cut and punch 82 eventually reaches the lowest position shown in FIG. 6. At this time, roller 96 dwells briefly in slot 98; so that, edge 14 of web 10 moves unimpeded through a radially extending slot 114 provided in cutting end 84 at a location just above slot 104. Edge 14 moves through slot 114 until the punch and die assembly 58 has been rotated away from web 10, at which point cam 100 begins to retract punch 82. Because slot 114 serves only as a passage for the edge of web 10 after formation of a notch, no tapers are required as in the case of slot 104.

In a preferred embodiment of the invention, notches 12 were provided every nine inches on a web 10 formed from acetate, polyester or paper film and having a thickness of 0.005–0.006 inch, using a punch 82 rotating on a turntable 56 at a 1.432 inch radius and at a speed matching the linear speed of web 10. Punch 82 was 0.180 inch in diameter; slots 104 and 114 were 0.090 inch deep radially at their centers; shearing edge 112 was 0.060 inch below the bottom wall of notch 114; the axial height of notch 104 was 0.100 inch; and the axial height of notch 114 was 0.100 inch. Although this particular geometry was found to be quite suitable for the application described, those skilled in the art will appreciate that substantial variations in the sizes of the components of the invention may be made without departing from the scope of the appended claims.

While the invention has been shown and described with reference to particular embodiments thereof, those skilled in the art will understand that numerous other variations in the form and detail of both the apparatus and method may be made without departing from the spirit and scope of our invention.

Having described our invention in sufficient detail to enable those skilled in the art to make and use it, we claim:

1. Apparatus for edge notching a moving web, comprising:

first means for supporting such web to provide a substantially straight run of such moving web;

at least one die means having an opening for at least partially defining the geometry of a notch to be made in such moving web;

at least one cylindrical punch means having a shape and a shearing edge for cooperating with said opening to form such notch;

second means for supporting said die means and said punch means on opposite sides of such moving web;

means for rotating said second supporting means about an axis substantially perpendicular to the plane of such straight run so that said punch means and said die means move in substantially parallel planes on said opposite sides; and means for driving said shearing edge of said punch means through such moving web and said die means at least once during each revolution to form such notch and for withdrawing said shearing edge of said punch means after formation of such notch, said punch means comprising a first radially extending slot through which an edge portion of such moving web passes prior to actuation of said means for driving, said shearing edge being formed by said first slot, and a second radially extending slot, spaced axially on said punch means from said first slot, through which an edge portion of such moving web passes after actuation of said means for driving.

2. Apparatus according to claim 1, wherein said means for driving comprises a cam fixedly mounted adjacent said means for rotating and a cam follower connected to said punch means and positioned to move on said cam during rotation of said second means for supporting.

3. Apparatus according to claim 2, wherein said second means comprises a turntable supporting said die means and said punch means and at least one counterweight positioned opposite to said die and punch means to balance said turntable during rotation.

4. Apparatus according to claim 3, wherein said cam comprises a cylindrical body having an axis coincident with the axis of said means for rotating and an exterior surface with a slot formed in and extended around said surface, said cam follower being positioned in said slot and said slot being configured to drive said cam follower and said punch means to form such notch.

5. Apparatus according to claim 2, wherein said cam comprises a cylindrical body having an axis coincident with the axis of said means for rotating and an exterior surface with a slot formed in and extended around said surface, said cam follower being positioned in said slot and said slot being configured to drive said cam follower and said punch means to form such notch.

6. Apparatus according to claim 1, wherein said second means comprises a turntable supporting said die means and said punch means and at least one counterweight positioned opposite said die and punch means to balance said turntable during rotation.

7. Apparatus according to any of claims 1,2,3,4,5 or 6, further comprising means for mounting said second means for movement transversely relative to such a web, whereby the transverse location of such notch may be adjusted for a particular web or for webs having different widths.

8. Apparatus according to claim 1 wherein said opening is round.

* * * * *